US008546754B2

(12) United States Patent
Makarov et al.

(10) Patent No.: US 8,546,754 B2
(45) **Date of Patent: *Oct. 1, 2013**

(54) ION TRAP

(75) Inventors: Alexander A. Makarov, Bremen (DE); Mikhail A. Monastyrskiy, Moskow (RU); Dmitry E. Grinfeld, Ramenskoye (RU)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/204,043

(22) Filed: Aug. 5, 2011

(65) Prior Publication Data

US 2011/0284737 A1 Nov. 24, 2011

Related U.S. Application Data

(63) Continuation of application No. 12/521,706, filed as application No. PCT/IB2007/004434 on Dec. 27, 2007, now Pat. No. 8,017,909.

(51) Int. Cl.
*H01J 49/42* (2006.01)
*H01J 49/26* (2006.01)

(52) U.S. Cl.
USPC ..... 250/292; 250/282; 250/281; 250/283; 250/290

(58) Field of Classification Search
USPC ..... 250/292, 282, 281, 283, 290
See application file for complete search history.

(56) References Cited

U.S. PATENT DOCUMENTS 5,420,425 A 5/1995 Bier et al.
5,569,917 A 10/1996 Buttrill, Jr. et al.

(Continued)

FOREIGN PATENT DOCUMENTS

JP 07-124918 A 12/1995
WO WO 02/078046 A2 10/2002

(Continued)

OTHER PUBLICATIONS

Steven M. Michael et al., "An Ion Trap Storage/Time-of-Flight Mass Spectrometer," Rev. Sci. Instrum. 63 (10), American Institute of Physics, pp. 4277-4284, (1992).

(Continued)

*Primary Examiner* — Nikita Wells
(74) *Attorney, Agent, or Firm* — Charles B. Katz

(57) ABSTRACT

An ion trap comprises substantially elongate electrodes 10, 20 some of which are curved along their axis of elongation and which define a trapping volume between them. The sectional area of this trapping volume towards the extremities of the trap in the direction of elongation is different to the sectional area away from its extremities (eg towards the middle of the trap). In a preferred embodiment, the trap has a plurality of elongate electrodes, wherein opposed electrodes have different radii of curvature so that the trap splays towards its extremities. Thereby, a wider mass range of ions can be trapped and ejected, a higher space charge capacity (for a given trap length) is provided, and sharper ion beam focussing on ejection is possible.

10 Claims, 5 Drawing Sheets

(56) References Cited

U.S. PATENT DOCUMENTS

| | | | | |
|---|---|---|---|---|
| 5,576,540 | A | 11/1996 | Jolliffe | |
| 5,689,111 | A | 11/1997 | Dresch et al. | |
| 5,763,878 | A | 6/1998 | Franzen | |
| 5,847,386 | A | 12/1998 | Thomson et al. | |
| 5,962,851 | A | 10/1999 | Whitehouse et al. | |
| 6,020,586 | A | 2/2000 | Dresch et al. | |
| 6,297,500 | B1 | 10/2001 | Franzen et al. | |
| 6,545,268 | B1 | 4/2003 | Verentchikov et al. | |
| 6,670,606 | B2 | 12/2003 | Verentchikov et al. | |
| 6,831,275 | B2 | 12/2004 | Franzen et al. | |
| 7,019,285 | B2 | 3/2006 | Dresch et al. | |
| 7,351,965 | B2 * | 4/2008 | Wells | 250/292 |
| 7,405,400 | B2 * | 7/2008 | Wells | 250/292 |
| 8,017,909 | B2 * | 9/2011 | Makarov et al. | 250/292 |
| 8,304,720 | B2 * | 11/2012 | Senko et al. | 250/290 |
| 2007/0029473 | A1 | 2/2007 | Verentchikov | |
| 2007/0045533 | A1 | 3/2007 | Krutchinsky et al. | |
| 2008/0035842 | A1 | 2/2008 | Sudakov et al. | |

FOREIGN PATENT DOCUMENTS

| | | | |
|---|---|---|---|
| WO | WO 03/102517 | A2 | 12/2003 |
| WO | WO 2005/124821 | A2 | 12/2005 |
| WO | WO 2006/129109 | A2 | 12/2006 |

OTHER PUBLICATIONS

Steven M. Michael et al., "Detection of Electrospray Ionization Using a Quadrupole Ion Trap Storage/Reflectron Time-of-Flight Mass Spectrometer," Anal. Chem. 65, pp. 2614-2620, (1993).

Randy W. Purves et al., "Development and Characterization of an Electrospray Ionization Ion Trap/Linear Time-of-Flight Mass Spectrometer," J Am Soc Mass Spectrom 8, pp. 1085-1093, (1997).

Alfonz Luca et al., "On the Combination of a Linear Field Free Trap with a Time-of-Flight Mass Spectrometer," American Institute of Physics, Rev. Sci. Instrum. 72 (7), pp. 2900-2908, (2001).

* cited by examiner

ION TRAP

CROSS-REFERENCE TO RELATED APPLICATIONS

The present application is a continuation under 35 U.S.C. §120 and claims the priority benefit of co-pending U.S. patent application Ser. No. 12/521,706, filed Jun. 29, 2009, which is a National Stage application under 35 U.S.C. §371 of PCT Application No. PCT/IB2007/004434, filed Dec. 27, 2007, which claims the priority benefit of United Kingdom Patent Application No. 0626025.1, filed Dec. 29, 2006. The disclosures of each of the foregoing applications are incorporated herein by reference.

FIELD OF THE INVENTION

This invention relates to an ion trap for storing and/or ejecting charged particles to a mass analyser. In particular, though not exclusively, the present invention relates to an ion trap suitable for injecting ions into an electrostatic trap such as a multi reflection time-of-flight analyser or an orbitrap.

BACKGROUND OF THE INVENTION

Ion traps, including RF ion traps, are well established devices that permit ion storage and ejection of stored ions into mass analyzers such as ion cyclotron resonance (ICR) analysers. Kofel, P.; Allemann, M.; Kellerhals, H. P. & Wanczek, K. P. External Trapped ion Source for ion Cyclotron Resonance Spectrometry, International Journal of Mass Spectrometry and Ion Processes, 1989, 87, 237-247 describe a rectangular trap in which all sides are held at the same potential, and the stray field from the ICR magnet produces the trapping action. Additionally the use of an ion accumulation RF-trap in or outside the magnetic field is suggested in that document.

S. Michael, M. Chien, D. Lubman, in Rev. Sci. Instrum., 1992, 63, 4277-4284, in U.S. Pat. Nos. 5,569,917, and in 5,763,878 describe the use of a 3D quadrupole ion trap as an accumulator and injector into a TOF mass analyser. However, the limited volume of the ion cloud in the traps of this prior art resulted in significant Coulomb interactions between stored ions that greatly affects parameters of resulting ion beams.

Linear ion traps and curved ion traps allowed an increase in the volume of ion cloud and thus reduced the levels at which space charge effects start to affect performance (normally, the allowed number of ions is increased by an order of magnitude or more). Therefore, they have proved to be more suitable for mass spectrometry as well as for ion injection into mass analyzers. Senko M. W. et.al. J. Am. Soc. Mass Spectrom. 1997, 8, 970-976 summarise the use of a range of different traps for use with FT-ICR spectrometers, and describe the use of an octapole ion guide as an accumulator, followed by a second octapole as an injector, ions being transferred out of the ends of the traps in the direction of the trap axis, rather than orthogonally to it. Franzen, in U.S. Pat. No. 5,763,878 describes a trap comprising parallel straight rods with ion ejection orthogonal to the rods. Makarov et.al. describe a curved multipole rod trap with orthogonal ejection, in U.S. Pat. No. 6,872,938.

However, as the ion cloud is distributed along a substantial length of the trap axis this makes subsequent focusing in this direction problematic. A cooled ion cloud lies at the minimum of the RF quasi-potential, and this centre-line ("axis") may be curved as in U.S. Pat. No. 6,872,938.

Both the recently introduced orbitrap mass analyser, and multi-reflection time-of-flight analysers, require not only high space charge capacity but also the ability to focus ion clouds in time and in all directions, including axially. A curved ion trap that focuses ions through a tiny entrance slot of the orbitrap mass analyzer is described in U.S. Pat. No. 6,872,938. The focusing is provided by the shape of the curved ion trap itself as well as by using curved focusing and deflection optics that lie between the trap and the Orbitrap mass analyser. The deflection optics (z-lens) also serves to reduce pressure problems by leading the ions on a curved path thus blocking direct line of sight (and ion fly aver) between the relatively high pressure storage trap and the target mass analyzer or trap.

Though providing high performance, the resulting construction has a number of disadvantages. Firstly, it is complicated to manufacture, secondly, it requires wide slits (with the widths reducing when focal points are approached) leading to increased requirements on differential pumping, and thirdly the trap suffers from the disadvantage that it has a space charge capacity lower than that of the orbitrap itself.

Furthermore, the lenses between the trap and the mass analyser are curved and complex to manufacture and align. In addition, the mass range of ions that can be accumulated and injected into the mass analyser is limited.

SUMMARY OF THE INVENTION

Against this background, and in accordance with a first aspect of the present invention, there is provided an ion trap comprising a plurality of elongate trapping electrodes, arranged so as to form a trapping volume therebetween, the trapping volume being generally elongate with an axis of elongation, and wherein the sectional area of the trapping volume near its extremities in the elongate direction differs from the sectional area of the said trapping volume away from the extremities thereof.

The inventive concept in its most general sense thus defines a curved, non-linear trapping field for ions. This arises from the surprising notion that a higher trap capacity and a higher quality of spatial and time-of-flight focusing could be provided by an ion storage device with, for example, extensively (but differently) curved electrodes. The new trap departs from the traditional point of view towards RF-ion traps which normally use lower order multipole expansion (e.g. quadrupolar, octapolar, etc.). Despite the widely held view that curved non linear electrodes would be too complex and unpredictable to serve for storage and pulsed injection of highly focused beams, the inventors have recognized that RF-traps react extremely gracefully or even positively to distortions of the storage field as far as ion storage is concerned. So instead of unnecessary binding to shapes that stem from multipole expansions and their transforms to electrode shapes (using Stokes' theorem), the ion-optical performance for the ejection is used as the dominating design principle, the RF design being only second. This honours the fact that the RF is typically (but not necessarily) switched off during ejection of ions towards the analyzer anyway.

In an alternative aspect the invention resides in an ion trap comprising a plurality of elongate trapping electrodes arranged so as to form a trapping volume therebetween which has an axis of elongation, and a power supply for supplying an rf voltage to the trapping electrodes, wherein the shape of the trapping electrodes and/or the magnitude of the applied rf voltage are chosen so as to create an electric field within the trapping volume that imposes an electric force on ions therein, the amplitude of which electric force changes with distance along at least a part of any line drawn parallel with the axis of elongation of the trap.

In other words, the trap is configured to establish a quasi potential well with a non-constant coefficient of parabolicity. In preference, the axis of elongation is at least partly curved, for example by employing curved electrodes in at least one plane, so that the amplitude of the electric force changes with distance along any line parallel with the curved axis (that is, along any line that follows at a fixed distance to the curved axis). In most preferred embodiments this introduction of a component of electric force parallel with the axis of elongation (which results in an ejecting force on ions in the trap which is neither perpendicular to nor parallel with the axis of elongation of the trap) is achieved by employing electrodes in at least one plane that have different radii of curvature or, even more preferably, one generally flat, planar electrode opposing one curved electrode (so that the sectional area of the trap changes with distance along the axis of elongation).

Advantages of preferred embodiments of this invention include:

- A wider mass range of ions able to be successfully trapped and ejected, because the low mass cut-off of the trap is blurred by the variable gap between the electrodes.
- For the same trap length, a higher space charge capacity. This is due to the ability to better squeeze the ion beam immediately prior to ejection.
- Narrower slits for differential pumping can be used due to the reduced width of the ejected ion beam. This is due to the stronger focusing action able to be produced by the use of, for example, electrodes with differing curvatures.
- Lower cost of production for the ion optics following the injection trap (z-lens has now simple planar symmetry instead of complex curved shape).
- Lower cost of production for the injection trap itself (plates replace curved hyperbolic rods the surfaces of which are difficult to machine).
- Sharper focusing of ion beam.
- Ability to eject ions in a mass to charge ratio independent manner.

Further features and advantages of the present invention will be apparent from the appended claims and the following description.

BRIEF DESCRIPTION OF THE DRAWINGS

The invention may be put into practice in a number of ways and some embodiments will now be described by way of example only, referring to the accompanying drawings in which.

DETAILED DESCRIPTION OF A PREFERRED EMBODIMENT

Figure 1:
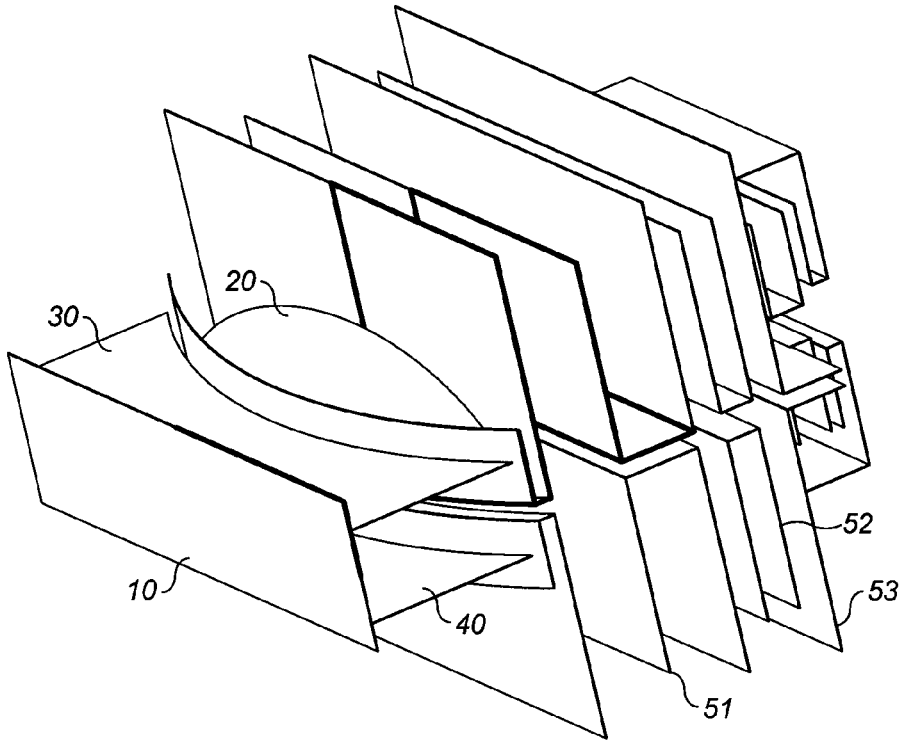
FIG. 1 shows a perspective view of a preferred embodiment of an ion trap in accordance with the present invention, along with downstream ion optics.
Figure 2:
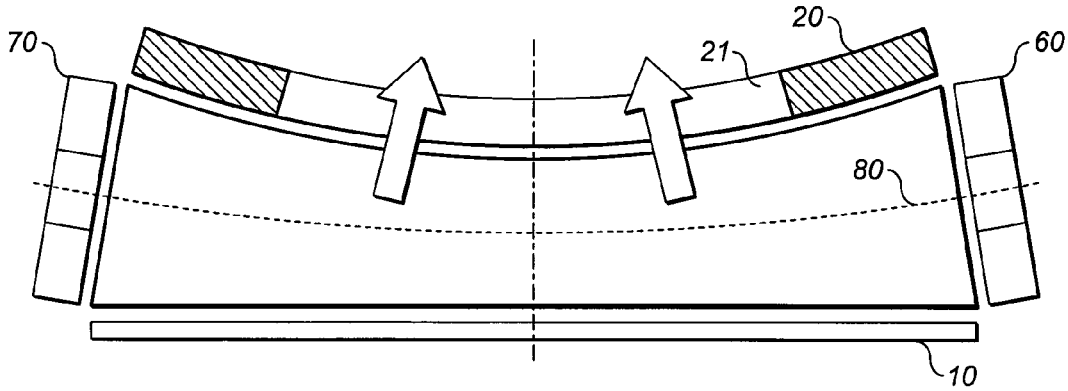
FIG. 2 shows a sectional view of the ion trap of FIG. 1, in the plane of ion motion.
Figure 3:
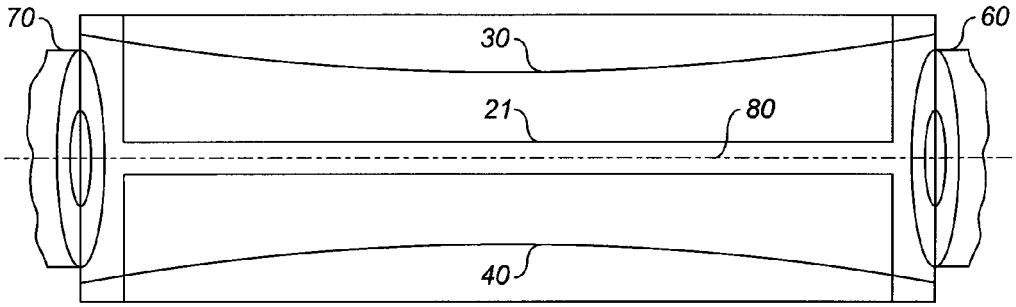
FIG. 3 shows a sectional view of the ion trap of FIG. 1, perpendicular to the plane of ion motion.

An ion storage trap in accordance with a preferred embodiment of the present invention will now be described with reference to the Figures. In contrast with previous devices having parallel or concentric surfaces of trap electrodes, it has been found to be both possible and advantageous to have surfaces with different curvatures Some examples are shown in FIGS. 1, 2 and 3.

The trap is formed from substantially elongate electrodes unlike the 3D quadrupole ion trap). These electrodes have a different spacing from each other at both ends of the trap than they do in the central region of the trap—the ends of the electrodes are splayed out at the ends, or constrict at the ends. The number of electrodes can be 3 or more. Preferably an even number of electrodes is used. A four-electrode device is specifically described here, with splayed ends. The splaying of the ends of the electrodes can be seen in the Figures, most clearly in FIGS. 2 and 3, where electrodes 10 and 20 diverge from each other towards the ends of the trap, as do the inner surfaces of electrodes 30 and 40. An immediate advantage of traps of this type of construction is that they allow a wider mass range of ions to be successfully trapped and ejected, because the low mass cut-off normally present in an RF quadrupole device is blurred by the variable gap between RF-electrodes 10-40. A similar advantage is gained if the rods constrict towards their ends, rather than splay.

The trap has end plates 60 and 70 to which voltages are applied. Prior to ejection of ions from the trap, the potentials applied to electrodes 60 and 70 cause the ions to move towards the centre of the trap, compressing the ion cloud. Cloud compression can be achieved by increase of the voltage on the end plates 60 and 70, To the same effect a DC applied to the RF electrodes could be changed in the opposite direction. Both methods lead to a deepening of the potential well, with the ions of constant energy then being constricted to a smaller space. The cloud compression could be done slowly by ramping (adiabatically) or just by a change of the voltages and subsequent collisional cooling. Cloud compression produces a second advantage of the invention, which is that the trap has an increased storage capacity. This advantage is particularly obtained if the electrodes splay towards their ends.

In addition to this, the difference of the curvatures of the trapping electrodes 10 and 20 can be utilized to create a net field that produces strong focusing of ion beam along the axial direction, and unlike prior art devices, this strong focusing starts to take place inside the trap. This produces an increased spatial focusing effect and in turn allows the use of planar z-lens electrodes 51, 52, 53 (FIG. 1) instead of the prior art curved electrodes. This is because these electrodes need not have such a strong focusing action, and the ion beam is smaller when it reaches these lens elements because the trap has produced a more tightly-focused ejected ion beam. This beam can be directed through smaller differential pumping apertures and this helps reduce the cost of the instrument by reducing the gas load on the mass analyser. These advantages can be gained whether the electrodes splay towards their ends or constrict, as will be shown later.

The properties of the electric field are dominated by three electrode surfaces. The first is the inner surface of the trapping electrode 10, that is, the surface of electrode 10 which faces the electrode 20 and which is hidden from view in FIG. 1. The second surface to dominate the electric field is the inner surface of the trapping electrode 20 (the surface of electrode 20 visible in FIG. 1 and facing the electrode 10). The third and most dominant surface is the outer surface of that trapping electrode 20 (facing towards the z-lenses 51, 52, 53, and again hidden in FIG. 1). Although these three surfaces do not themselves focus, they are nevertheless the surfaces which are "seen" primarily by ions as they are ejected from the trap. As such they play a dominant role in ion focussing and may be considered the ejection field determining surfaces.

Generally, the centre of curvature of the first electrode(s) through which ions are ejected (i.e. "pull-out" electrode 20) or the back electrode (i.e. "push-out" electrode 10) should be closer to the trap than the point of focusing in the axial direction. It is preferable though not obligatory to have centres of curvature of electrodes 10, 20 on the same line as the ion focal point. It is also preferable to use this line as an axis of symmetry of the trap. Generally, $$(R2<|R1| \text{ and } R2<f) \text{ or } (|R2|>R1 \text{ and } R1<f)$$

wherein R1 is radius of curvature of electrode 10, R2 is the radius of curvature of electrode 20 and f is the distance from the ion focal point to the axis. The sign |. . . | denotes an absolute value and indicates that the corresponding radius could have a negative curvature, i.e. its centre could lie on the other side of the trap relative to the ion focal point.

Then, subsequent (preferably flat) lenses 50 slightly reduce but do not compensate fully the initial focusing action of electrode(s) 20 and/or 10. Typically, ions are coining through slit 21 at lower energies than through lenses 50. It has been found that optimisation of the geometry and voltages for given ion beam parameters allow the trap plus lenses to provide spatial and time-of-flight aberrations comparable to those of curved trap and lens system.

As the result of strong curvature of electrode 20 and/or 10, the direction of ion ejection from the trap is not orthogonal to the curved axis but substantially deviates from orthogonal.

Additionally, the more complex shape increases the strength of higher order fields, thus helping to increase the space charge capacity of the trap. Furthermore, as described above, the gap between RF electrodes 10 and 20 increases away from the centre of the trap, and that allows the field from the end-plates of the trap 60, 70 to penetrate deeper into the trap and squeeze the ion cloud to a smaller length (for otherwise similar electrical and geometrical parameters). Preferably, the RF along the axis is kept balanced by also increasing the gap G between electrodes 30 and 40 in the vertical direction, as noted above and in FIG. 3. Typically though not essentially, G approximately equals the gap between electrodes 10 and 20. Typically, the curvature R3, R4 of the electrodes 30 and 40 is $$|R3|>R2; |R4|>R2,$$

their centres of curvature lying outside of the plane of ion motion. The curved shape of the electrodes normally precludes from using the trap with resonance excitation (which is usually not required anyway as the trap serves mainly to prepare ion pulses for a subsequent mass analyser), but use for crude mass selection or selection of masses with harmonic relationships is still possible, especially when non-linearities are engineered for this purpose, for example a hexapolar or octopolar multipole component dominating over higher order non-linearities. By addition of the higher order multipole field components the stability region becomes more complex than in the simple quadrupolar case. This leads to a more complicated mass scan function and may cause selection or deselection of ions together with those primary targeted at. As opposed to pure or slightly perturbed quadrupole fields where analytical expressions for the determination of ion stability are known, definition of mass selection properties or selective mass instability scans may require numerical determination of ion stability regions and deviation from current operation practices or even complete experimental determination of mass selection operational parameters.

In operation, (positive) ions enter the trap via apertures 60 or 70 (FIG. 2) and are prevented from divergence by the RF potential applied to electrodes 10 and 20 (phase 1) and that applied to 30 and 40 (anti-phase, FIG. 3). Apertures 60 and 70 typically have a DC offset relative to the DC potential on electrodes 10-40 (which is normally the same for all rods though optionally the DC potential of electrode 10 could be more positive than that of electrode 20 to improve ion focusing within the trap). Alternatively an RF potential could be applied to aperture electrodes 60 and 70 for storage. This could have independent frequency and amplitudes. Besides use for storage of particles of only one charge polarity this RF on the aperture electrodes can be used for simultaneous storage or confinement of positive and negative ions. When positive and negative ions are confined in the same space they can be used for various operations, including but not limited to electron transfer reactions, including electron transfer dissociation (ETD), charge transfer reactions, including charge state reduction, charge exchange reactions or sympathetical cooling. Some of these methods are also possible by transmission of a beam of opposite charge through the trap, but storage allows for longer reaction times, especially if cooling or a kinetically limited reaction are desired.

Collisions with residual gas within the trap reduce the kinetic energy of ions until they are trapped inside it. Optionally, ions pass through the trap multiple times before they are cooled along axis 80, as described in WO-A-2006/103445.

Figure 4:
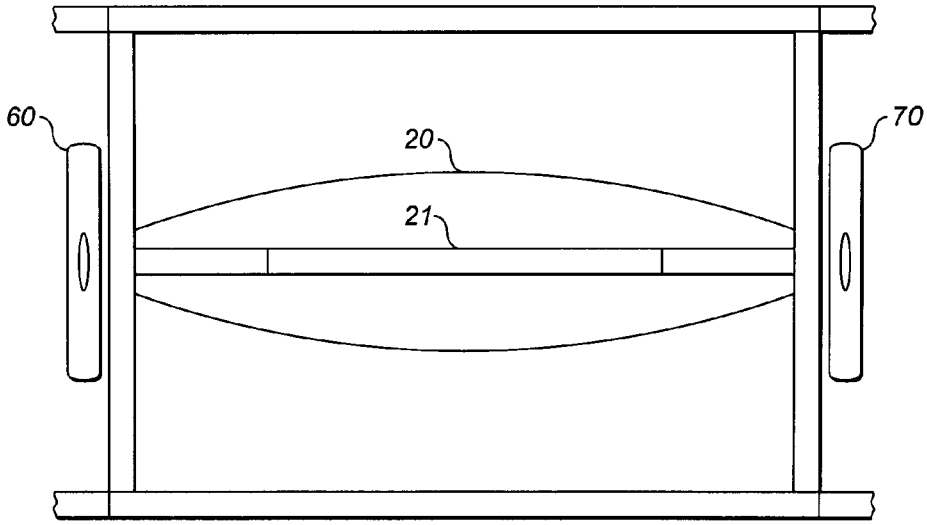
FIG. 4 shows a front view of the trap of FIG. 1, viewed from the direction of the ion optics.

Apertures 60, 70 are preferably made as printed-circuit boards (PCBs) with metallization on both sides and inside the aperture. These boards could be used to enclose the trapping volume and reduce gas flow into the vacuum system. Such enclosure, however, introduces the possibility of breakdown along the surface. The latter may be avoided by milling a very thin (0.1-0.2 mm for 1 mm thick PCB) groove which separates the metallised areas from the dielectric areas without substantially increasing gas flow. In certain areas (e.g. near the points where the apertures 60 or 70 approach the electrodes 20 or 10), electrodes 10 or 20 could have a small recess (also 0.1-0.2 mm) which provides an additional gap without a noticeable increase of gas flow. Ceramic plates could be also used to enclose the trapping volume from top and bottom as shown in FIG. 4.

Figure 5:
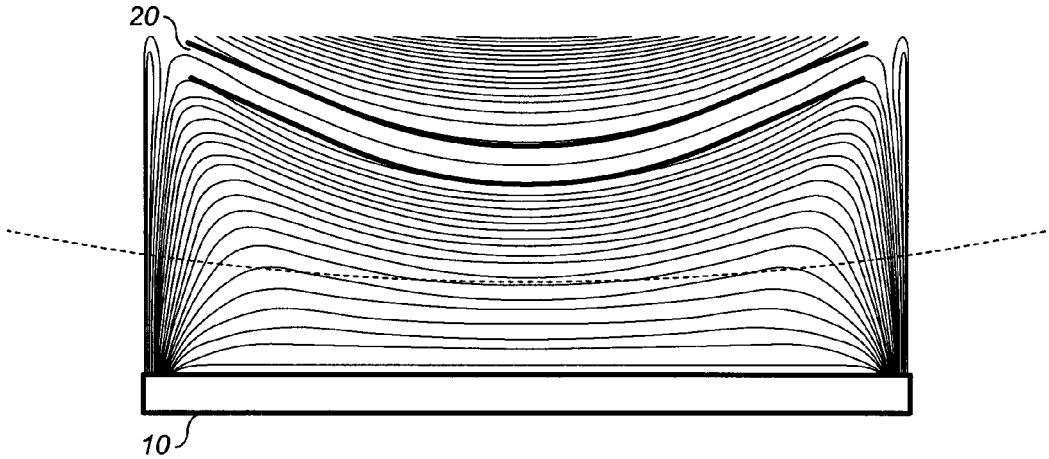
FIG. 5 shows a typical potential distribution in the plane of ion extraction of the ion trap of FIG. 1.
Figure 6A:
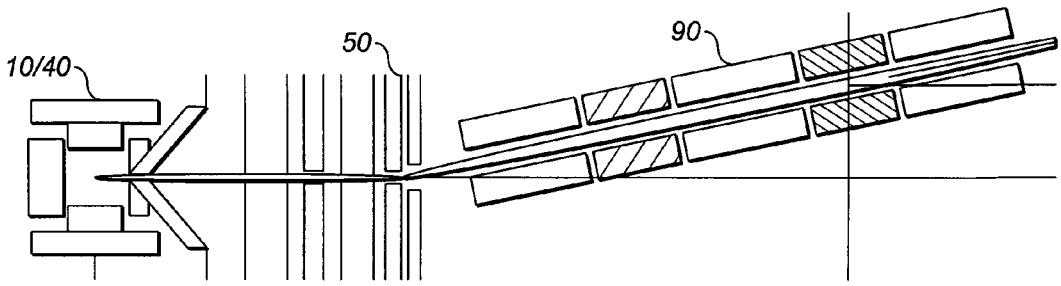
FIGS. 6*a*, 6*b* and 6*c* show top, plan and side views of the trap of FIG. 1, along with a downstream lens system to produce a parallel ejected ion beam.
Figure 6B:
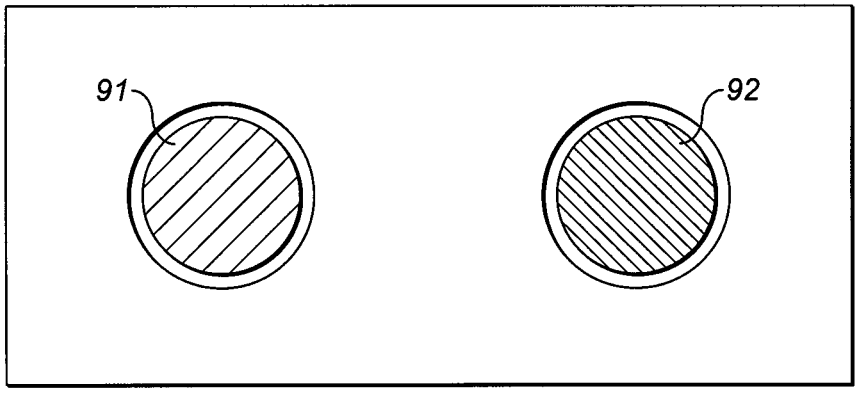
Figure 6C:
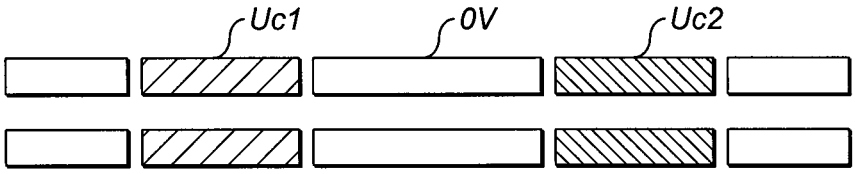

Following trapping, ions may be additionally squeezed away from apertures 60-70 by increasing the voltages on them (as described above). After that, the RF potential on electrodes 10-40 is shunted as described in WO-A-05/124, 821 and DC voltages are applied to these electrodes to create an extracting field which accelerates ions towards electrode 20 and at the same time pushes them to the axis of the trap (as the field has a substantial axial component as exemplified by equipotentials of FIG. 5). There might be a delay between shunting the RF and applying the DC voltages so that better time-of-flight or spatial focusing is achieved. Optionally, time-varying voltages could be applied instead of DC potentials. The field forces ions to exit the trap via slot 21 in electrode 20 (FIGS. 2 and 4) and enter lens assembly 50 which guides them through optional differential pumping into the mass analyser, which is preferably an orbitrap or time-of-flight mass analyser. For the former, it is preferable to have focusing of the ion beam into a point while for a time-of-flight analyser it is preferable to provide a parallel beam of larger size. The latter is achieved, by a lens assembly 90 shown in FIGS. 6*a*, 6*b* and 6*c*, preferably including a pair of cylindrical lenses 91, 92. Carryover of gas from the trap into the mass analyser is avoided by using a single or double deflection of the ion beam as shown in FIG. 6 or in WO-A-

02/078046. The lens assembly is preferably a set of plates separated by dielectric or resistive spacers.

Figure 7A:
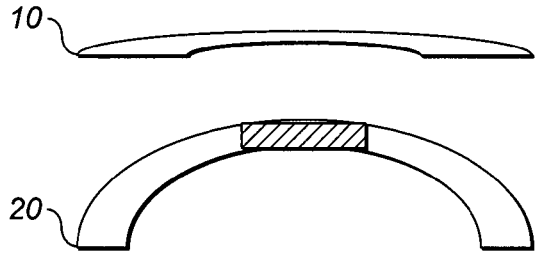
FIGS. 7*a*, 7*b*, 7*c* and 7*d* show various schematic alternative electrode arrangements in accordance with the present invention.
Figure 7B:
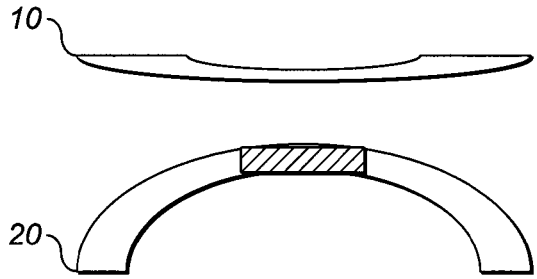

Possible variants are shown in FIGS. 7*a* to 7*d*. Referring first to FIG. 7*a*, the overall appearance of an ion trap embodying the present invention is shown, on the ion beam plane. The radius of the electrode 10> radius of the electrode 20. FIG. 7*b* shows the overall appearance of an ion trap in accordance with an alternative embodiment of the present invention, on the ion beam plane. The radius of the electrode 10 is here negative. In both FIGS. 7*a* and 7*b*, both electrodes 10 and 20 are curved, but the inner surfaces are not parallel, with the gap between those surfaces being larger at the ends of the electrodes than it is in the centre of the trap.

Figure 7C:
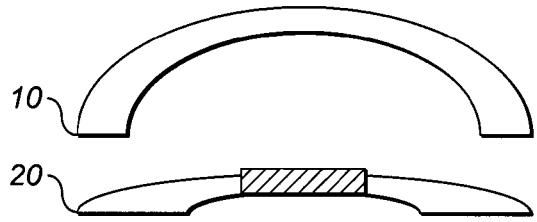
Figure 7D:
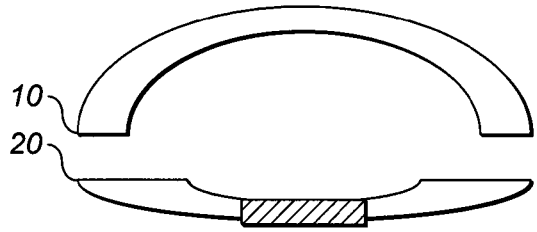

Alternatively, instead of having the electrodes splay at the ends, they can instead constrict. Here both electrodes 10 and 20 are curved, but the inner surfaces are not parallel, with the gap between those surfaces being smaller at the ends of the electrodes than it is in the centre of the trap. Examples of this are shown in FIGS. 7*c* and 7*d*. In FIG. 7*c*, a first such embodiment is shown, wherein the radius of electrode 20> the radius of electrode 10.

Still a further embodiment is shown in FIG. 7*d*, wherein the radius of the electrode 20 is less than zero.

When used with a time-of-flight mass analyser, curvatures R1 and R2 could be optimised to provide the lowest aberrations and/or highest independence of ion beam parameters on space charge, preferably upon exit of ions from the trap—further downstream, it becomes more challenging to optimize these parameters. The entrance of a time of flight mass spectrometer is preferably located behind a correction lens (not shown) which converts the ion beam from a focussed beam into a more parallel beam. This correction lens may be close to the focal point of the trap or may be either side of it. It may be convenient to enter the TOF MS in the first time focus, downstream of the correction lens. In using a TOF MS device, one particularly suitable arrangement is the multireflection TOF MS device we describe in our application entitled "Multireflection Time of Flight Mass Spectrometer" filed on 21 Dec. 2007 at the UK IPO, the contents of which are incorporated herein by reference. The multichannel detection system of our copending application number GB0620963.9 may be particularly preferred to detect ions passing through that or any other TOF MS device, and the contents of that are incorporated by reference.

For the orbitrap mass analyser, the main criterion is tight spatial focusing for large space charge and sometimes appropriate dependence of ion energy on mass. Again it is desirable that the entrance to the orbitrap is located as close as possible to the focal point of the ion bean departing the curved non linear ion trap.

Other shape variants of front and back electrodes may be envisaged, for example:

push-out electrode 10 is planar, pull-out electrode 20 is curved (concave as viewed from the outside front of the trap)

electrode 20 is planar; electrode 10 is curved (convex as viewed from the outside front of the trap;

push-out 10 is planar, pull-out 20 is hyperbolic on the outside, curved on the inside;

electrode 10 is planar, electrode 20 is cylindrical;

electrodes 10 and 20 are hyperbolic;

both electrodes are cylindrical.

The shape of electrodes 10 and 20 should be optimised for a particular task. For example, the best shape for injection into the orbitrap could be different from the best shape for lowest time-of-flight aberrations.

Special shape variants of top and bottom electrodes 30 and 40 may also be contemplated, such as, but not limited to:

Hyperbolic;

Cylindrical;

symmetrical, curved to keep vertical electrode separation similar to horizontal separation (FIG. 3);

asymmetric (usually used to assist deflection during ejection);

curvature of top and bottom electrode such that the axial field is as close to quadrupolar as possible (or e.g. to maximise specific higher order terms);

curvature of top and bottom electrodes such that an effective potential gradient along the RF-potential minimum line is generated (or avoided).

The focusing properties of the trap can be optimized by taking into account the shape of the outer side of electrode 20. This electrode face also takes part in shaping of the ejected ion beam.

Shape variants of the outer side of the electrode 20 (optimised to provide best focusing in the vertical direction):

Figure of rotation with a triangle or circle as a base (toroid) as shown in FIG. 4. Slit 21 should be relatively narrow (preferably not thicker than its height).

Long channel within a massive electrode to minimise gas streaming from inside the trap.

Although a specific embodiment of the present invention has been described, it is to be understood that various modifications and improvements could be contemplated by the skilled person. For example, it is to be understood that, whilst curved electrodes of differing radii and centres of curvature may be employed to achieve the improved ion storage and/or spatial focussing upon ejection, a similar effect could be achieved in other analogous ways. For example, instead of a continuous elongate electrode, one or more of the trapping electrodes could instead be formed of shorter electrode sections. Each of these electrode sections could be curved or straight; either way a curved composite electrode may be formed. Indeed, by application of differential electric fields to the electrode sections, they could all be collinear and the appropriate change in electric field along the trap could still be achieved. Generation of an electric field in this manner is described in respect of another ion trap geometry (the orbitrap) in our copending application published as WO-A-2007/000587, hereby incorporated by reference.

The trap of the present invention is suitable for use in many different arrangements, particularly those that are optimally arranged with a 2D type trap that receives ions in a first direction (normally generally along the longitudinal direction of the trap) and ejects them orthogonally. For example, the curved non linear trap may be particularly useful in the arrangement of our copending application number PCT/GB2006/001174, which is incorporated by reference in its entirety.

The invention claimed is:

1. An ion trap, comprising a plurality of elongate trapping electrodes, an ion exit aperture for ejecting ions from the trap, and a voltage supply means configured:

(a) to supply a trapping voltage to the elongate trapping electrodes so as to trap ions within an ion trapping volume, and (b) subsequently to supply an ejection voltage to the trap so as to cause ions trapped therein to be ejected from the ion exit aperture in a direction which is neither parallel with, nor orthogonal to, the direction of elongation of the trap; and wherein the trapping electrodes and the ejection voltage between them generate an electric field which is non linear along the direction of elongation of the trap, so that ions at different positions along the direction of elongation of the trap upon application of the ejection voltage experience different electric field potentials so as to cause spatial focusing of the ions downstream of the trap.

2. The trap of claim 1, wherein at least two of the elongate electrodes are curved, and have different radii of curvature and different centers of curvature.

3. The trap of claim 1, wherein the exit aperture is formed in one of the plurality of elongate electrodes.

4. The trap of claim 3, wherein the exit aperture is formed substantially at a center point along the length of the at least one elongate electrodes.

5. An ion trap comprising a plurality of elongate trapping electrodes arranged so as to form a trapping volume therebetween which has an axis of elongation, and a power supply for supplying an rf voltage to the trapping electrodes, wherein at least one of the shape of the trapping electrodes and the magnitude of the applied rf voltage are chosen so as to create an electric field within the trapping volume that imposes an electric force on ions therein, the amplitude of which electric force changes with distance along at least a part of any line drawn parallel with the axis of elongation of the trap.

6. The ion trap of claim 5, wherein the axis of elongation is at least partly curved.

7. The ion trap of claim 6, wherein at least one of the trapping electrodes is curved.

8. The ion trap of claim 7, comprising first and second opposed trapping electrodes at least one of which is curved so that the distance between the first and second electrodes changes along the direction of elongation of the trap.

9. A method of trapping ions in a trapping volume of an ion trap which a plurality of elongate trapping electrodes, the method comprising:

creating an electric field within the trapping volume which imposes an electric force on ions therein, the amplitude of which electric force changes with distance along at least a part of any line drawn parallel with the axis of elongation of the trap.

10. The method of claim 9, wherein the step of creating an electric field within the trapping volume includes applying an rf voltage to the trapping electrodes.

* * * * *